US007140490B2

(12) United States Patent
Przytulla

(10) Patent No.: US 7,140,490 B2
(45) Date of Patent: Nov. 28, 2006

(54) PALLET CONTAINER

(75) Inventor: Dietmar Przytulla, Kerpen (DE)

(73) Assignee: Mauser-Werke GmbH & Co. KG, Brühl (DE)

( * ) Notice: Subject to any disclaimer, the term of this patent is extended or adjusted under 35 U.S.C. 154(b) by 8 days.

(21) Appl. No.: 10/827,828

(22) Filed: Apr. 20, 2004

(65) Prior Publication Data

US 2004/0195243 A1 Oct. 7, 2004

Related U.S. Application Data

(63) Continuation of application No. 10/231,431, filed on Aug. 29, 2002, now abandoned, which is a continuation of application No. PCT/EP01/05908, filed on May 23, 2001.

(60) Provisional application No. 60/245,332, filed on Nov. 2, 2000.

(30) Foreign Application Priority Data

May 25, 2000 (DE) ..... 200 09 265
Oct. 18, 2000 (DE) ..... 200 17 895

(51) Int. Cl.
*B65D 19/00* (2006.01)

(52) U.S. Cl. ..... 206/386; 220/23.9; 220/495

(58) Field of Classification Search ..... 206/386, 206/600; 220/1.5, 1.6, 9.1, 9.4, 23.9, 23.91, 220/485, 459.01, 495; 52/165
See application file for complete search history.

(56) References Cited

U.S. PATENT DOCUMENTS 4,909,387 A * 3/1990 Schutz ..... 206/386
4,947,988 A * 8/1990 Schutz ..... 206/386
5,645,185 A * 7/1997 Cassina ..... 220/1.5
5,678,688 A 10/1997 Schutz
5,848,502 A * 12/1998 Schaefer ..... 52/165
6,290,082 B1 * 9/2001 Van Giezen et al. ..... 206/386
6,488,167 B1 * 12/2002 Napp ..... 220/9.1

FOREIGN PATENT DOCUMENTS

DE 196 42 242 A1 3/1998
DE 297 19 830 U 5/1998
EP 0 734 987 A2 10/1996
EP 0 755 863 A1 1/1997

* cited by examiner

*Primary Examiner*—Luan K. Bui
(74) *Attorney, Agent, or Firm*—Henry M. Feiereisen; Ursula B. Day

(57) ABSTRACT

In a rigid thin-walled inner receptacle from thermoplastic material for storage and transport of fluid or free-flowing loads, with a cage of crossed hollow bars closely surrounding the plastic receptacle as a support jacket and a bottom pallet which supports the receptacle and on which the support jacket is firmly attached, the crossed vertically and horizontally extending hollow bars which are welded to each other at welding points and configured such that they are free of any dimples in their contact area at a point of intersection, and each of the hollow bars are provided laterally next to the point of intersection with at least one dimple laterally and at a distance from the point of intersection respectively the welding point.

21 Claims, 8 Drawing Sheets

PALLET CONTAINER

CROSS-REFERENCES TO RELATED APPLICATIONS

This application claims the priority of German Patent Applications Serial Nos. 200 09 265.0, filed May 25, 2000 and 200 17 895.4 filed Oct. 18, 2000, the subject matter of which is incorporated herein by reference.

This application is a continuation of U.S. Ser. No. 10/231,431, filed on Aug. 29, 2002, now abandoned.

This Application claims benefit of prior filed provisional U.S. application Appl. No. 60/245,332, filed Nov. 2, 2000.

This application is a continuation of prior filed copending PCT International application no. PCT/EP01/05908, filed May 23, 2001.

BACKGROUND OF THE INVENTION

The invention relates to a pallet container having a thin-walled rigid inner receptacle made from thermoplastic material for the storage and transport of fluid or free-flowing goods, wherein the plastic container is closely surrounded by an outer cage jacket as a supporting casing of crossed hollow bars and a bottom pallet on which the thermoplastic receptacle is supported and which is firmly connected with the supporting casing.

Pallet containers of the type that have a supporting casing from welded hollow bars are generally known, as for example the pallet container disclosed in EP 0 734 987 A (Sch). The supporting casing of the pallet container disclosed there consists of hollow bars having a circular profile that are highly compressed at the welded intersection points. From EP 07 55 863 (F) another pallet container is known with hollow bars that have a square profiled cross section and that are each partially slightly compressed, about 1 mm, at four contact points and only in the areas of intersections in order to facilitate a better welding action, while along the entire length of the hollow bars, they retain a cross section without any dimples, or have any cross section-reducing dents whatsoever.

Another pallet container, known from the DE 196 42 242 A, has a cage jacket from hollow bars that have an open trapezoid shaped profile, where the straight surfaces laterally flanged outwards, are welded together in the area where the bars intersect.

The bottom pallet of the pallet containers may be configured as a flat pallet made from plastic or wood or configured as a steel tube frame; and attachment of the cage jacket is usually realized by attachment means such as for example, screws, brackets, clamps or grips that engage with the lower horizontal and circumferentially extending cage bars. These attachment means are nailed, riveted, screwed or welded to the upper plate or the upper outer edge of the pallet.

The drawbacks of the embodiment of a pallet container disclosed in the afore-described EP 0 734 967 A are such, that the circular hollow profile of the horizontal and vertical cage hollow bars, particularly in the area of the intersections, are prone to considerable deformation, specifically at the side of the welding points and therefore exhibit a markedly reduced section modulus as compared to the other areas. Also, welding the hollow bars causes material brittleness precisely in the area of the dented hollow bar profile. Additionally, the hollow bar profile is still deeper dimpled next to the dimples for the welding points and thus, further weakened.

In industrial applications, for example when the pallet containers are utilized in the chemical industry, they have to pass a governmental approval inspection and fulfill various quality controls. For example, the filled pallet containers have to undergo interior pressure tests and drop tests in which the pallet container is dropped from specified heights. Pallet containers or combination IBCs (IBC=Intermediate Bulk Container) of the type discussed here—with a filling volume of usually 1000 liters—are preferably used in the transport of liquids. When transporting filled combination-IBCs in particular by truck, the content in the fluid container is prone to considerable gushing motions which are generated by transport shocks, such as for example when the transport vehicle rides on bumpy roads. Thus, constantly changing pressure forces are exerted on the interior receptacle walls, which in turn lead to radial vibrational motion of the cage jacket (dynamic continuous vibrational stress). Depending on the configuration of the cage jacket, especially during long transports over bad roads, vibrational stress builds up to such an extent that the cage bars get fatigued and/or break. Pallet containers of this type are therefore not suitable for multiple usage or for export to the USA.

SUMMARY OF THE INVENTION

According to one aspect of the present invention, an improved pallet container is provided which is designed to obviate the afore-stated shortcomings and which is configured with improved transport strength and with improved resistance against transport stress and against long-term vibrational motion stress.

In another aspect, the present invention provides a pallet container suitable for transporting dangerous fluids or free-flowing loading goods up to the highest standard of approval quality.

These aspects, and others which will become apparent hereinafter, are attained in accordance with the present invention, wherein the pallet container has a cage jacket of vertical and horizontal steel hollow bars which either lack any dimples, or are only very slightly indented or dimpled at the contact area at a point of intersection of the bars and wherein such a slight dimple in one of the bars is equal or less than twice the thickness of the width of the hollow bar, that is in concrete terms, about 2 mm or less, and wherein each of the hollow bars are provided with at least one dimple laterally next to the intersection, or respectively the welding point, each of which dimple is located at a distance of about one tenth of the hollow bar width (B) from the welding point to thereby realize a wanted bending point. Thus, upon transferring the wanted bending points to a certain distance away from the critical welding points, the varying bending stresses that result from vibrations to the cage jacket are accommodated, that is, the continuous bending stresses no longer occur at the brittle and thus critical welding points, but predominantly only on the comparatively non-critical bars and at points of considerably higher bending elasticity, not directly at the stiffened intersections. In order to improve the bending elasticity of the vertical or/and horizontal hollow bars, they can be configured so that they are free of dimples at the side opposite the contact area in the area of the intersection, and each of the hollow bars can be provided with at least one dimple laterally next to the intersection, that is, on the other side of the welding points, to thereby establish a wanted bending point, each of which can also be at a distance of at least one tenth of the hollow bar width (B) from the welding point.

According to another feature of the invention an excellent bending elasticity of the cage jacket is realized, when the vertical or horizontal hollow bars are provided with at least two dimples which are between two intersections, at the side of the welding points, respectively at the contact area or/and at the side opposite the contact area.

It is very advantageous to provide each of the vertical or/and horizontal hollow bars at the side of the welding points between two intersections, at their contact area and the side opposite the side of the contact area, with at least one dimple, such that the dimples are located precisely opposite each other and wherein the dimples are located at a distance from the intersection of at least one tenth of the hollow bar widths (B). Thereby, the neutral phase of the bending stress is located well in the middle of the hollow bar.

According to another feature of the invention, the depth (T) of one dimple for reducing the height of the profile (H) is kept possibly small, that is, between about 15% and 50%, preferably about 33% of the height of the profile (H). The longitudinal extension of an dimple—in longitudinal direction—should be between one and one half times and three times of the profile width (B), preferably about twice the profile width (B). As a compromise, while least weakening the flexural strength, a sufficiently high bending elasticity in the wanted bending points, respectively the dimples, is thereby realized.

Since the intensity of the vibrational stress which occurs in the cage jacket of a pallet container filled with fluid varies, the dimples in each of the horizontal or/and vertical hollow bars can be formed with varying depth in dependence of the intensity of the occurring vibrational stress in the various sections of the cage jacket or/and in the horizontal and vertical hollow bars.

In a preferred embodiment, the vertical or/and horizontal hollow bars are provided with a very specific hollow profile, that is, a closed profile having a trapezoid shaped cross section with longer and shorter parallel extending side walls and two straight side walls which extend obliquely relative to one another, and which, starting from the longer of the parallel side walls extend obliquely towards each other, connect to the shorter wall, such that the two straight side walls that are extending obliquely relative to each other and form a crown angle of approximately 20° to 45°, preferably about 36°. The trapezoid shaped closed profile of the hollow bar has a high bending section modulus and a high torsion-section modulus due to the profile side walls being positioned relative to each other in a slightly oblique manner, which is particularly realized when the height to width (H/B) ratio of the trapezoid shaped tube profile is between 0.8 and 1.0, preferably about 0.86. In one embodiment of the invention, the longer parallel side wall of the hollow bar with the trapezoid shaped profile, partially in the area the intersection of two hollow bars, is dimpled inwardly along a length of approximately two widths of a hollow profile in such a manner, that at each of the two outer longitudinal edges they form an outward curvature (bulging), so that four points are formed at each intersection of the vertically and horizontally extending cage bars that are firmly joined after welding, whereby in each of the cage bar intersections the longer parallel walls which face each other are not in contact with each other even after being welded.

In a preferred embodiment, the longer of the parallel walls of the cage bar with a trapezoid shaped profile is dimpled inwardly along its entire length to form a continuous longitudinal dimpling or profiling, such that the two outer longitudinal edges are formed with an outwardly extending curvature (bulging), and that at each intersection of the horizontally and vertically extending cage bars four contact points are formed, which are firmly connected after being welded together, so that the longer opposing parallel walls are at a distance from each other even after being welded, and without contacting each other. In built prototypes, the trapezoid shaped cage bars, which are dimpled along their entire length, have proven especially outstanding in their use.

In a variation of this embodiment, the longer parallel wall of the trapezoid profiled hollow bar may be inwardly dimpled only partially in the area of an intersection and the longer parallel wall of the other trapezoid shaped hollow bar inwardly dimpled along the entire length, which configuration may prove already entirely adequate to sustain the average stress load.

The depth of the profiling dimple of the longer parallel wall is about twice that of the wall thickness of the profiled hollow bar; in an actual pallet container, the profiled hollow bar wall thickness is 1 mm and the depth A of the dimple is also 1 mm, so that after welding—whereby the contact points of the crossed cage bars melt into each other by about 1 mm—it is assured that at each intersection, the long parallel walls facing each other are spaced apart from each other by about 1 mm and are not in contact with each other, even after welding. This is viewed as particularly important because oftentimes pallet containers are stored outdoors and are thus exposed to the elements of weather. By providing a distance between the cage bars at the points of welding, accumulating rainwater can easily dry off and formation of rust is thereby substantially prevented. If the welding surfaces were in contact, the formation of rust would be unavoidable leading to extensive rusting of the cage bars within a short time.

According to a special feature of the invention, the hollow bar profile—as compared to the known hollow bar profiles—is not partially indented at the welding points, but is provided with corresponding dimples, respectively dents at a certain distance next to the welding points at the same side or/and at the opposite side of the profile, in order to realize a reduced bending section modulus relative to the intersecting points, and to relieve the welding points of the cage bars of static and/or dynamic stress. The preferred trapezoid profile is configured such that it can be indented easily and without extensive material displacement. Dimpling (=dimple, respectively denting, as a desired formation of "vibration elements") is carried out at only specific regions of the hollow cage bars, thereby effecting relief against vibrational stress and the fluctuating flexural tension peaks on the welded intersection or the four welding points. When welding one hollow bar together with a second hollow bar, stiffening of the hollow bar occurs and a corresponding material brittleness results at that location, making the hollow bar particularly sensitive to vibrational stress at that point. Considerable vibrational stress, which is present, for example, during transport by truck can lead in the shortest time to breaking of the welding points or the hollow bar itself at the welding points.

In accordance with the invention, the desired "wanted vibration points" in the cage jacket-support casing are not provided precisely at the intersecting points or in the proximate zone thereof, but at least a short distance from the welding points of the intersection. The wanted vibration points, which are provided by forming the dimples, are in any event less than 50% of the cross section of the hollow bar. They are arranged the range of 10% to 45% of the height of the hollow bar cross section, preferably about ⅓ (33%).

The flexural strength of the indented hollow bars is thereby somewhat reduced, but the proneness to fractures due to fatigue is considerably reduced.

BRIEF DESCRIPTION OF THE DRAWING

The above and other aspects, features and advantages of the present invention will now be described in more detail with reference to the accompanying drawing in which.

DETAILED DESCRIPTION OF PREFERRED EMBODIMENTS

Figure 1:
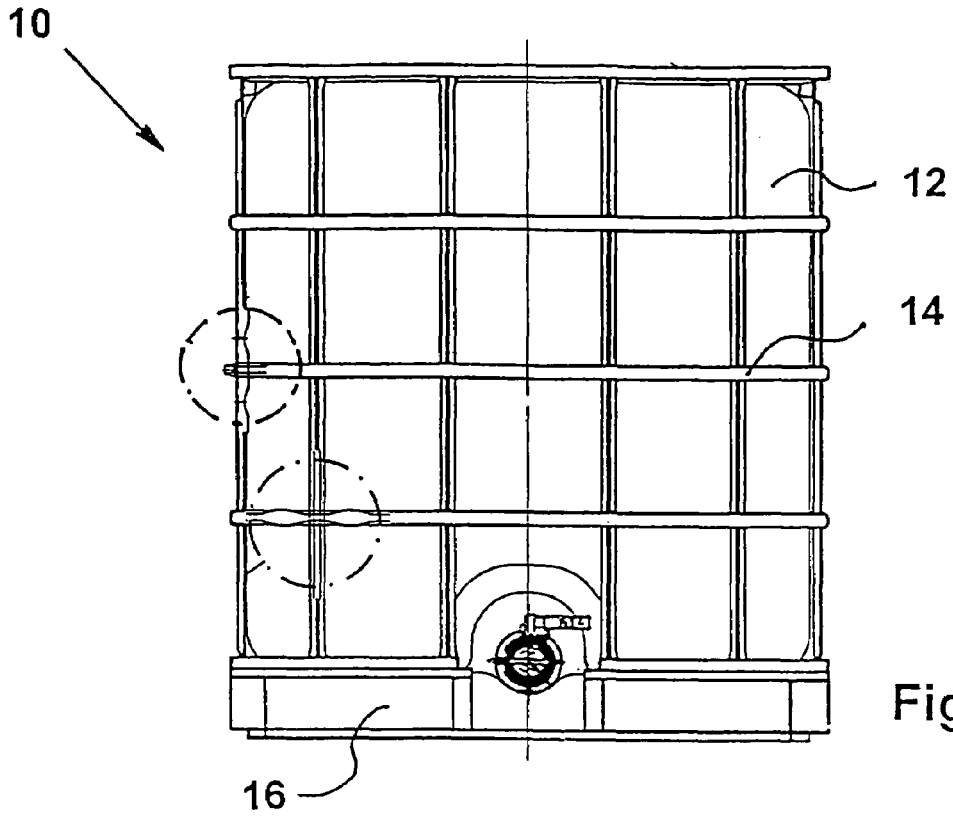
FIG. 1 a front view of a pallet container according to the invention.

This is one of two applications both filed on the same day. Both applications deal with related inventions. They are commonly owned and have the same inventive entity. Both applications are unique, but incorporate the other by reference. Accordingly, the following U.S. patent application is hereby expressly incorporated by reference: "Pallet Container"

Throughout all the Figures, same or corresponding elements are generally indicated by same reference numerals.

Turning now to the drawing, and in particular to FIG. 1, there is shown a pallet container according to the invention referenced with numeral 10 which shows a thin-walled blow-molded rigid inner receptacle 12 made of thermoplastic material (HD-PE) with an upper input opening and a cage of intersected hollow bars 14 closely enveloping the inner receptacle, and which is firmly—but detachably or interchangeably connected with the bottom pallet 16. The front view as depicted shows the narrow side of the pallet container 10 with an exit valve disposed at the plastic receptacle 12 near the bottom. The lower front edge of bottom pallet 16, here shown in configuration as a wooden pallet (US Runner), with the exit valve 18 situated above, represents the most vulnerable point of the pallet container, which is exposed to the greatest stress during approval testing, especially during the diagonal drop test. The special configuration of the cage bars with special dimples (cf. FIG. 7) are shown in the circles.

Prior to the development of the pallet container according to the invention, five different pallet containers known and available on the market were submitted to the precise comparative stress tests (interior pressure test, drop tests, vibration tests, test for pressure capacity upset, respectively testing stacking capacity). In serial vibration tests during simulation of long haul truck transport on bad roads, certain particularly frequently occurring weak points in various cage jackets were isolated.

Figure 2:
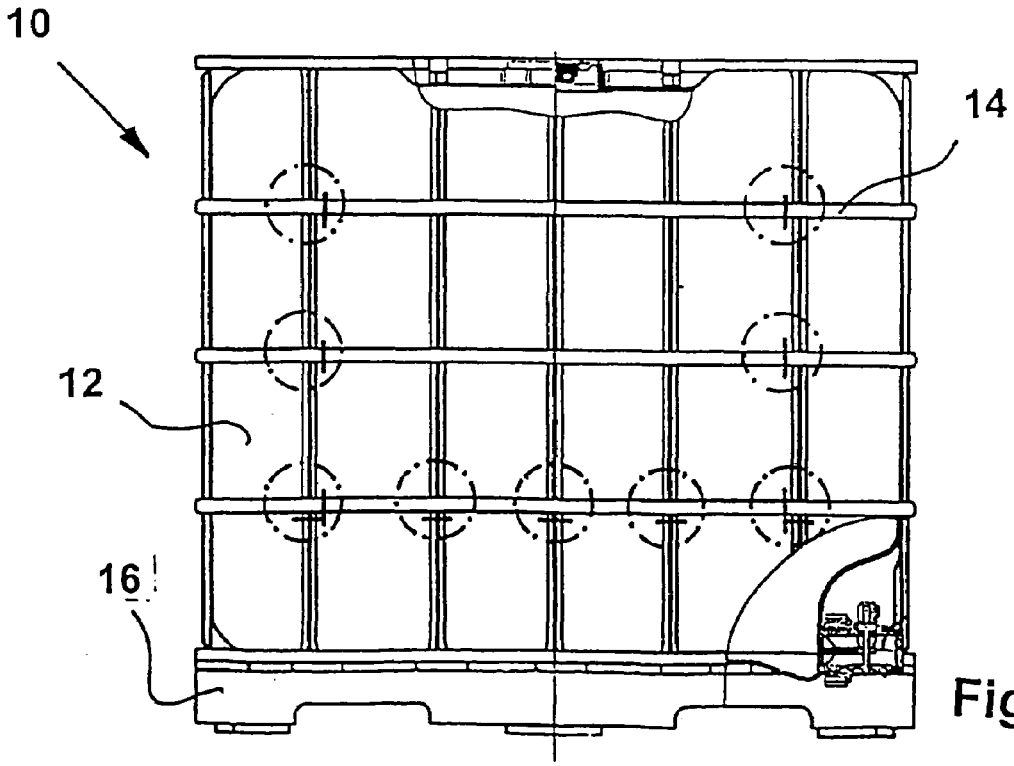
FIG. 2 a side view of a testing-pallet container.
Figure 10:
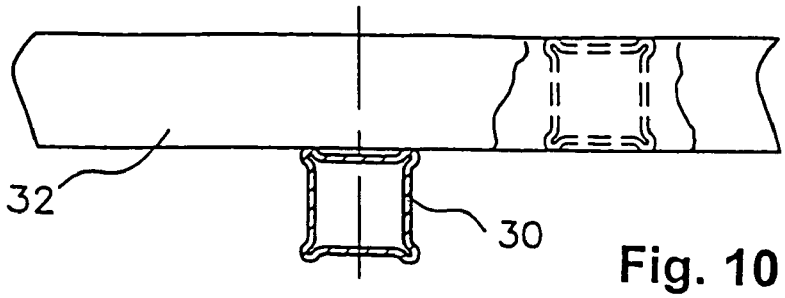
FIG. 10 a square shaped profile of a cross section of a hollow bar—in unstressed condition.
Figure 11:
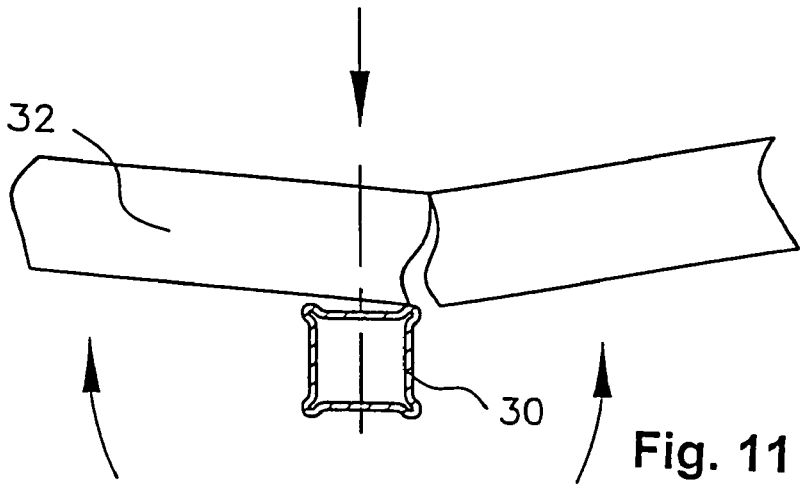
FIG. 11 the square shaped profile of a cross section of a hollow bar according to FIG. 10—in stressed or overstressed condition.

The test pallet container 10 (here shown without the elasticity promoting dimples) shown in FIG. 2, which for testing purposes was also deliberately submitted to continuous overload testing, is shown with circles drawn to illustrate those points marked at the horizontal and vertical cage bars, which are prone to fail and which begin to break first according to the comparative testing results during dynamic vibration stress, (cf. FIGS. 10, 11).

Figure 3:
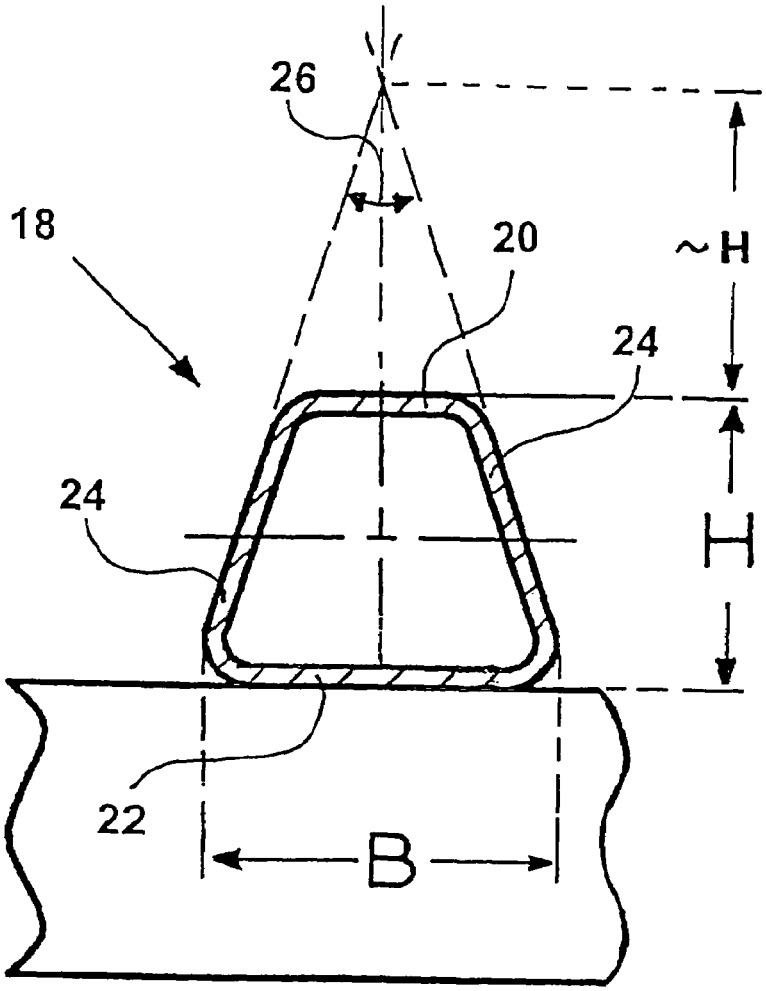
FIG. 3 an sectional illustration on an enlarged scale of the trapezoid shaped hollow bar profile according to the invention at a hollow bar intersecting point.

FIG. 3 shows an area of intersection with a closed hollow bar profile 18 having a trapezoid shaped cross section in accordance with the invention, a longer wall and a shorter wall extending parallel to each other 20, 22 and the two straight walls 24 extending obliquely relative to each other, and beginning from the longer parallel Wall 22 they extend obliquely and connect to the shorter wall 20, whereby the two straight side walls of profile 18 which extend obliquely relative to each other form a crown angle 26 between 20° and 45°, preferably about 36°. The ratio of height to width of the trapezoid shaped profile of the hollow bar is between 0.8 and 1.0,—preferably about 0.86. Due to the relatively great height of the trapezoid shaped profile (without dents in the oblique side walls) a correspondingly high flexural stiffness is realized, and due to the closed and compact configuration of the trapezoid shaped profile, the hollow bars exhibit an improved torsional stiffness as compared to hollow bar profiles that are configured with a circular profile or those having an open profile. The distance of the intersection of the extended horizontal axis of the walls 24 extending obliquely relative to each other at crown angle 26 is about the height H of the profile or, measured beginning from the longer parallel wall 20 is about 2 H. The distance can be between 0.75 and 2.5 H.

Figure 4:
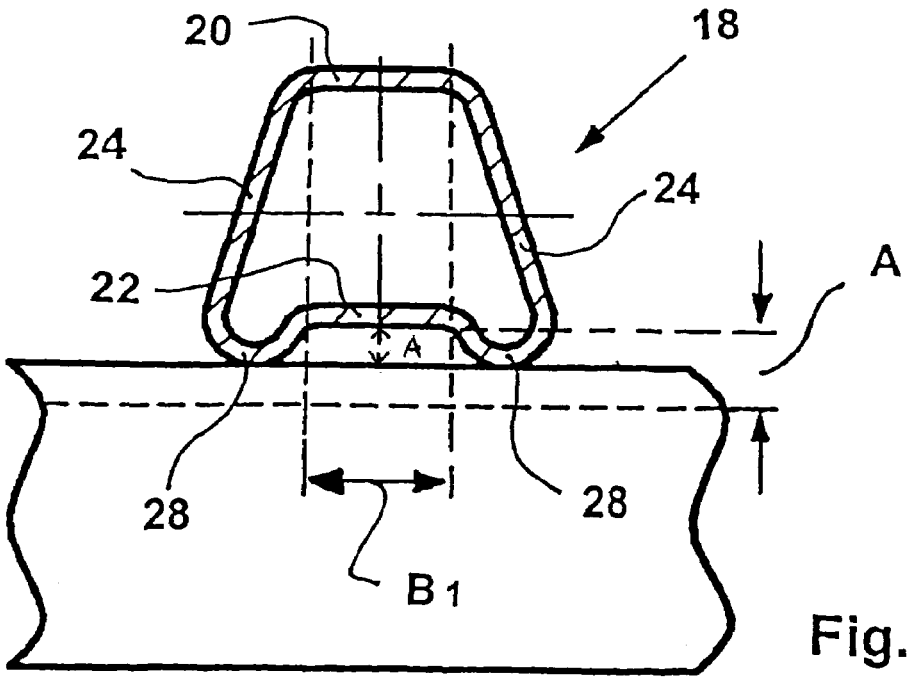
FIG. 4 a further sectional illustration on an enlarged scale of a preferred trapezoid shaped hollow profile at a hollow bar intersecting point.

The trapezoid shaped profile 18, preferably utilized is depicted in FIG. 4. In a simple embodiment, the longer parallel wall 22 is only partially inwardly dimpled in the area of the intersection of two hollow bars in such a manner that at each of the two outer longitudinal edges a curvature 28 (bulge) is formed that bulges outwardly, so that at each intersection of the horizontally and vertically extending hollow bars, four contact points are formed, which after being welded, are firmly connected to each other, whereby the longer parallel walls 22 in each hollow bar intersection are still spaced apart from each other without any contact even after welding.

In an especially preferred embodiment, the longer parallel wall 22 is dimpled inwardly along the entire length of the hollow bars, wherein the two outer longitudinal edges are provided with an outwardly bulging curvature 28. In the built prototypes, the continuously dimpled trapezoid shaped hollow bar profile 18 has proven outstanding and is being manufactured from a circular hollow bar having a diameter of 18 mm (56.55 mm in circumference). The depth of the dimple for the longitudinal profiling should be about once or twice that of the wall thickness of the hollow bar (about 1 mm to 2 mm); in a fully formed pallet container the wall thickness of the hollow bar is 1 mm and the depth of the dimple 1 mm. The welding at each of the four contact points at each intersection of the hollow bars is carried out by means of electrical resistance pressure welding. When carrying out the four-point welding, the crossing cage bars are being pressed together about 1 mm, so that the opposing parallel walls 22 in each intersection are still distanced from each other by about 0.5 mm to 2 mm, preferably, about 1 mm and are not in contact with each other even after being welded. (distance A=1 mm). This is a particularly important aspect, since pallet containers oftentimes are stored outdoors and are exposed to the weather. By distancing the cage bars from each other at the welding points, rain water, which might accumulate there, dries off by exposure to air, and thus, rusting is substantially prevented. Welding surfaces that are abutting each other are inevitably prone to formation of rust, which can lead to heavy rusting of the entire cage in the shortest time. Illustration of the cross section also clearly shows that the width of the (longer) parallel wall 22 that remains between the outwardly bulging edges 28 is approximately the same as the width B1 of the opposite (shorter) parallel wall 20.

Figure 5:
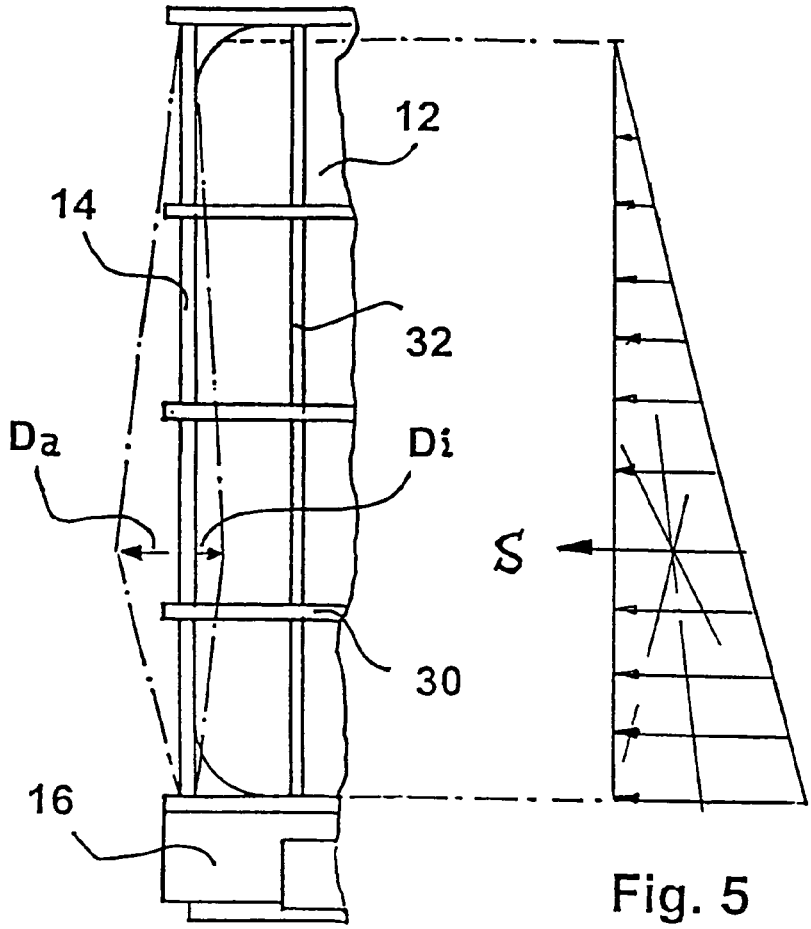
FIG. 5 a schematic sectional illustration of a hydrodynamic pressure effect of a fluid load on the container side-wall.

FIG. 5 illustrates the schematic representation of the changing deforming deflection of the cage jacket due to dynamic vibrational stress. The hydrostatic interior pressure of the fluid goods load—illustrated in the right hand side, causes the maximal cage deflection $D_a$, $D_i$ occurring approximately at the level of the center of gravity S of the filled goods, which means at about 33% of the cage height, and at that level the vibration amplitude toward the outside is approximately two times that of the inside, which is the reason the greatest danger of crack formation in the cage hollow bars during vibrational stress is in the area of the lower half of the cage.

Figure 6:
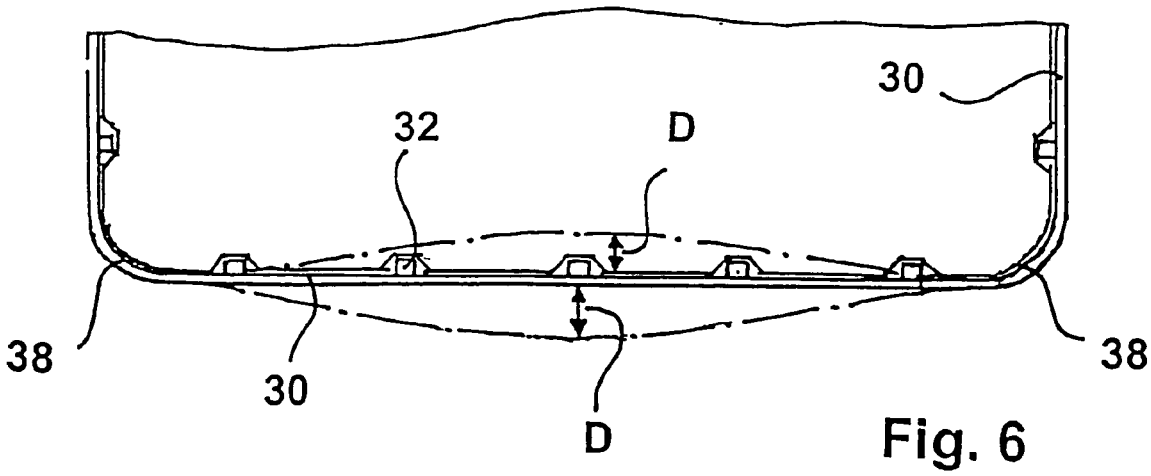
FIG. 6 a horizontal partial sectional illustration of a point of greatest outward deflection of the cage.

The schematic representation of a partial sectional view in FIG. 6 illustrates the horizontal cross section at the location of the maximal deformation effect $D_a$ and $D_i$. There is no interference of vibrational deflection directed towards the outside, while inside the fluid column encounters the opposite side wall. The lower circumferential horizontal cage bars 30 are thus submitted to great bending stresses particularly in the vicinity of the corner bends 38.

Figure 7:
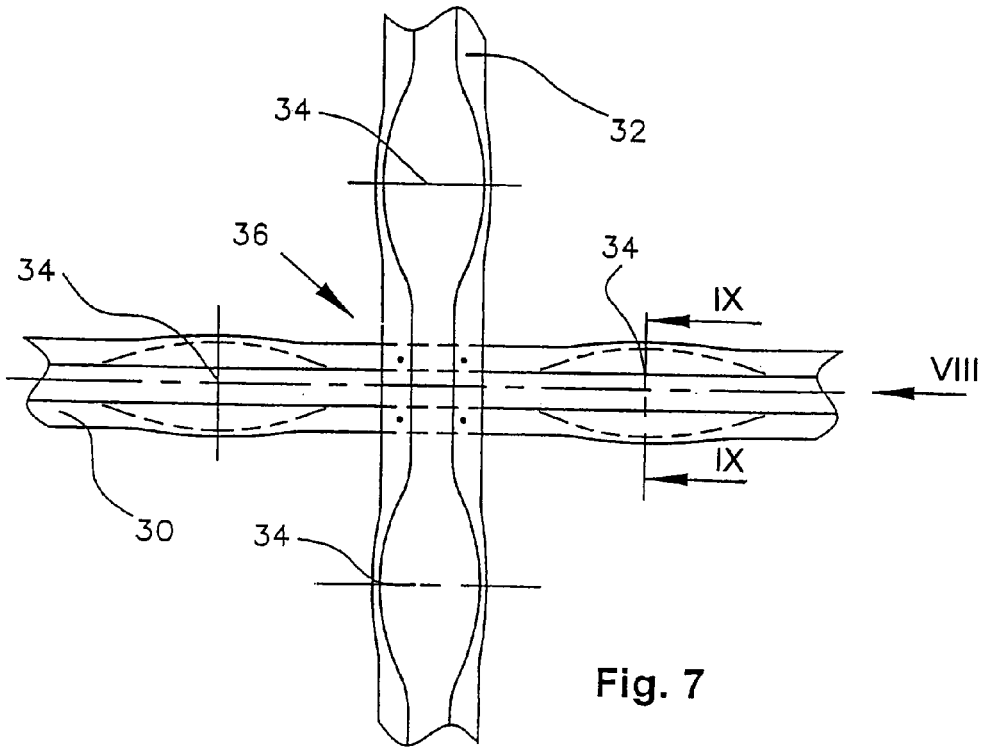
FIG. 7 an enlarged illustration of an intersection of hollow bars with dimples.
Figure 8:
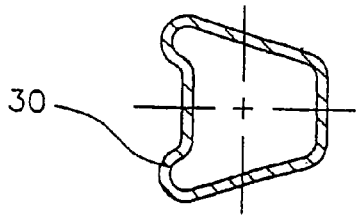
FIG. 8 a trapezoid shaped cross section of a hollow bar according to view VIII of FIG. 7.
Figure 9A:
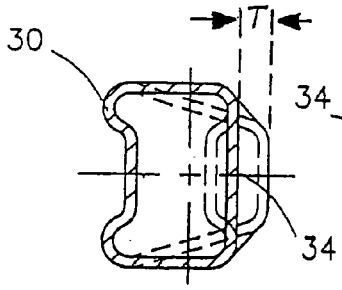
FIG. 9*a* a dimple on a trapezoid shaped cross section of a hollow bar (narrow side) IX—IX.
Figure 9B:
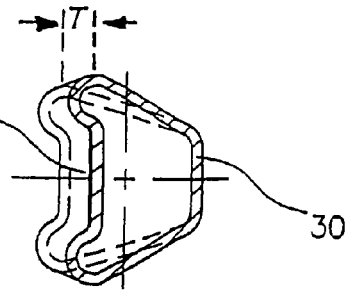
FIG. 9*b* a dimple on a trapezoid shaped cross section of a hollow bar (broad side) C—C.

FIG. 7 shows—in an interior view of the cage—the intersection 36 of a horizontal hollow bar 30 with that of a vertical hollow bar 32. In the intersection 36, the four welding points are indicated. The trapezoid shaped hollow profile of horizontal bar 30 and that of the vertical bar 32 is provided each with one dimple 34 at each side exactly next to the intersection 36, respectively the four welding points, wherein the dimples 34 are distanced to the point of intersection 36 by at least one tenth of the hollow bar width B. View VIII of the non-deformed trapezoid shaped profile 18 is shown in FIG. 8 and a sectional illustration of the dimple 34 along the line IX—IX is shown in FIG. 9*b*. The dimples 34 in the hollow bar can be provided on the side of the ("longer") parallel wall 22 (FIG. 9*b*) or/and on the side of the opposing ("shorter") parallel wall 20 according to FIG. 9*a*. Numerous variations may thereby be realized, so that between two cage bar intersections at least two dimples may be provided at the outer side of the trapezoid shaped profile or/and two dimples may also be provided at the inner side. It is however significant that the hollow bars in these embodiments are not indented or deformed directly at the point of intersection or respectively at the welding points, but only next to them.

When reducing the height H of the profile, the depth T of one dimple 34 should be kept low if possible, i.e. between 15% and 50%; in a preferred embodiment, the depth T of the dimple is about 33% of the height H of the profile. The longitudinal extension of dimple 34 along the bar should be between one and one half and three times the width B of the profile, and in a preferred embodiment, the longitudinal extension of an dimple 34 is about twice that of the profile width B.

FIG. 10 shows an unstressed hollow profile of the known type having a square shaped profile along the entire length of the bar. Already after a relatively short period of dynamic vibrational stress, formation of a crack is seen on the horizontal bar 30' directly at the intersection, respectively at the welding points, as is illustrated in FIG. 11.

The formation of cracks or respectively, the tearing of the cage bars always occurs in the area of highest pull tensions, or at the location where the greatest bulging of the cage jacket occurs. The vertical hollow bars are arranged at the inside of the cage jacket and the horizontal hollow bars are arranged at the outside. Cracks and fracture points always occur in the area of the intersection directly next to the welding points (cf. circled views in FIG. 2). Cracks start forming at the vertical hollow bars—relative to cage jacket—and always travel from the outside to the inside and always start on the inside of the horizontal bars travelling to the outside. In comparative tests, it has been found that the cage jackets made from cage bars with an open profile and provided with flat outwardly angled edges exhibit good stacking capacity because the welding points are relatively far part from each other within the intersection, but they react most unfavorable to vibrational stress.

Figure 12:
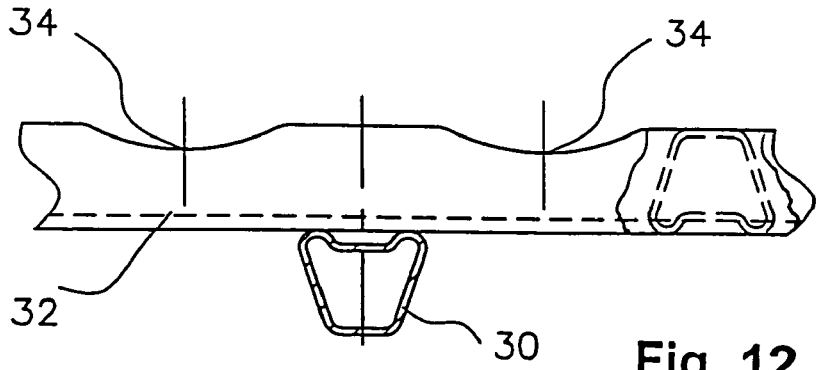
FIG. 12 a profile of a hollow bar according to the invention—in unstressed condition.
Figure 13:
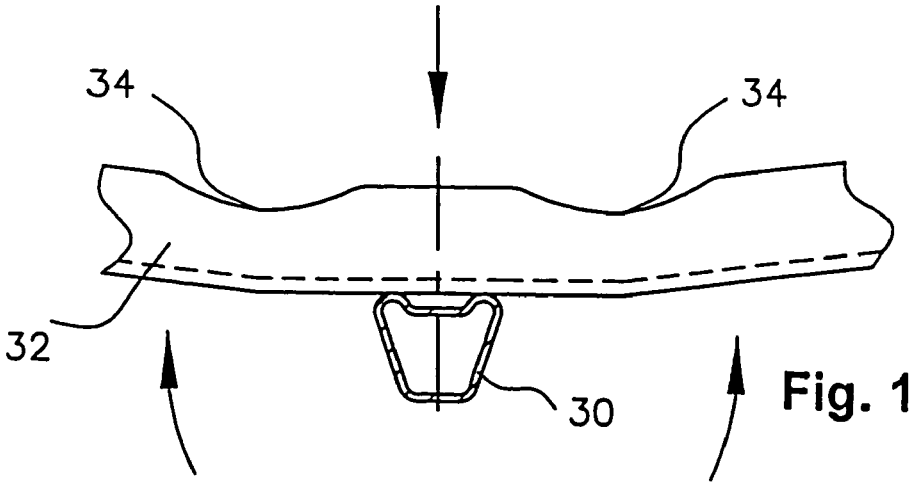
FIG. 13 the profile of a hollow bar according to the invention according to FIG. 12—in stressed condition.

As compared to the square shaped hollow profile, in FIG. 12, a closed trapezoid shaped hollow profile 18 in accordance with the invention, is shown here with two dimples 34 in a horizontal bar 30. As illustrated in exaggerated manner in FIG. 13, crack formation does not occur even after prolonged exposure to vibrational stress. This is due, on the one hand, to the intersecting area at the welding points lacking weakness-inducing dimples and therefore is very stable, while on the other hand, the dimples 34 reduce the bending section modulus and function as a kind of "bending hinge" when located at least at a small distance from the intersection, thereby acting to prevent the peak tensions impacting upon the sensitive welding points and shifting them away towards more distant flexible areas.

A dimple, which acts as a wanted bending point represents a reduction in the height of the hollow bar profile H and serves as a means for stress reduction against the occurring vibrational stress at the sensitive welding points at critical stress peaks during changing bending stresses. Thus, during occurrence of the dynamic vibrational stress, the critical tension peaks are shifted away from the welding points to adjacent areas at a distance thereto. By means of this special configuration, a substantial reduction in static or dynamic stress on the welding connections is realized by means of the dimples on the hollow bars, which are provided laterally at a distance to the welding points and which reduce the peak-stress, so that the welding points are not located in a deformation zone and thus retain their high flexural strength.

The special problems in constructing a particular embodiment of a cage jacket is that the vertical and horizontal cage bars should be as stable and rigid as possible in order to prevent excessive bulging of the pallet container which is, for example, exerted by interior pressure; and on the other hand, a high bending section modulus should be provided to counteract constant dynamic vibrational stress, wherein the two afore-mentioned criteria operate in opposite directions. Accordingly, while considering favorable, i.e. low production costs, an optimal solution must be found. Thus, known pallet containers having cage bars with a continuously even profile along the length of bar, as for example according to DE 297 19 830 U1, according to latest trends in the present invention, are not suitable as containers for carrying dangerous fluid loads submitted to dynamic vibrational stress; but may be suitable as storage containers, but not as a transport container undergoing dynamic vibration stresses. The afore-cited patent publication is based on the prior art insofar as the known pallet container has a cage jacket made from hollows with a circular cross section that are provided with dimples at least at the welded hollow intersections. A statement on page 2 of that patent disclosure which states " . . . by using a profiled hollow according the invention (that is, without any localized dimples) local tension accumulation is avoided . . . " does not correctly state the latest trends in the present invention and simply shows that the effect of the reciprocal connection between flexural strength and vibration elasticity were not taken into account when such cage jackets of pallet containers are submitted to transport stress.

The depth T of the dimples 34 in the trapezoid shaped profile according to the invention are approximately 25% and 50%, preferably approximately 33% of the height H of the hollow bar profile. A dimple of 5 mm (=33%) is generally sufficient for a bar having a height of 15 mm, whereby the vibrational stress at the welding points is either kept low or is eliminated while retaining a sufficiently high rigidity in the hollow. This rigidity is important in order to keep the vibration amplitude of the lateral bulging of the vibrating cage at a low level.

Figure 14:
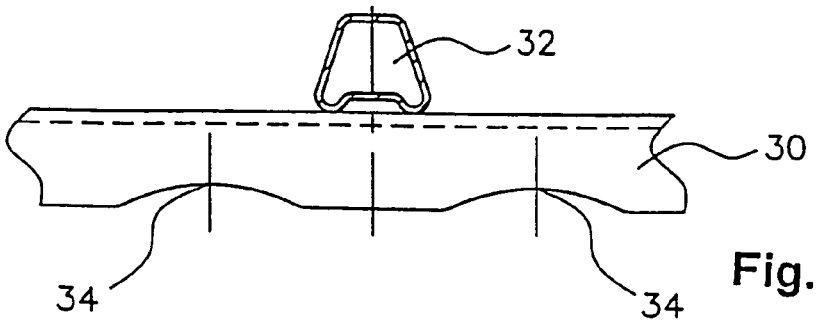
FIG. 14 another hollow bar profile according to the invention with two dimples.
Figure 15:
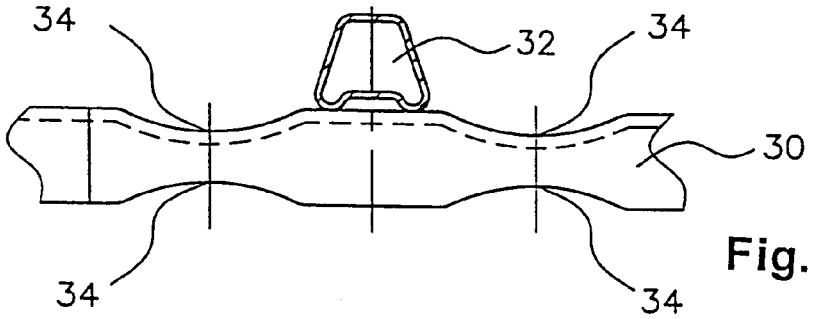
FIG. 15 a further hollow bar profile according to the invention with four dimples.

FIG. 14 illustrates an embodiment having two dimples 34 at the side of the hollow bar profile facing away from the welding points with the short parallel wall 20, and which—as is shown in FIG. 15—illustrates a modified and particularly useful variation of that embodiment. The trapezoid shaped hollow profile 18 is provided with dimples 34, each at the side of the shorter parallel wall 20 and on the side of the longer parallel wall 22 laterally next to an intersection 36, so that the dimples are exactly opposite each other. The dimples are spaced here at a distance of approximately one tenth of the width B of the hollow bar profile from the intersecting point 36. Placing the dimples 34 in each of the parallel extending sidewalls 20, 22, particularly enhances the "hinge effect" or the elasticity of the hollow profile.

According to the technical teaching of the present invention, the configuration of the dimples 34 in the horizontal and vertical hollow bars 30, 32 can be of different depth depending on the intensity of the dynamic stress expected to bear on the cage jacket 14. Thus, in accordance with a specific demand or need, while retaining sufficient flexural strength, the optimal vibrational elasticity in the horizontal and vertical hollow bars can be controlled in various areas of the cage jacket, for example in the longer side walls, or the shorter front and rear walls of the pallet container.

Figure 16:
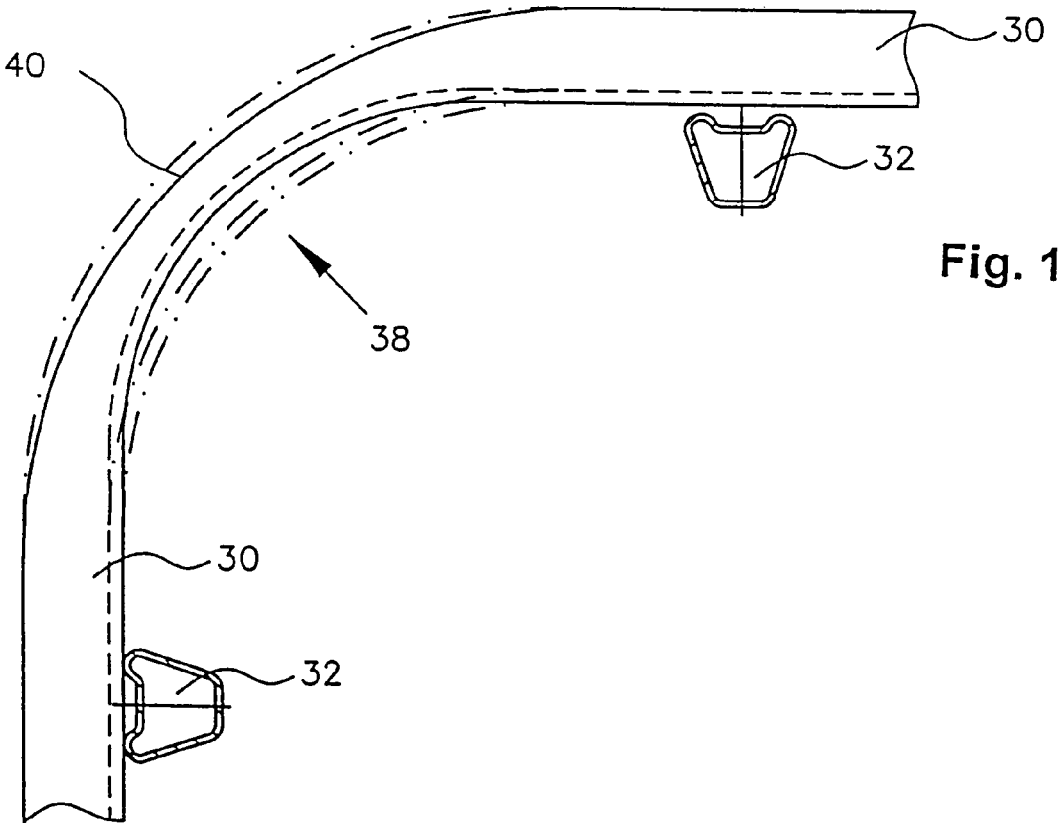
FIG. 16 a partial top view of a corner arc of the hollow profile according to the invention.

FIG. 16 illustrates a further important embodiment for reducing the bad effects of the dynamic vibrational stress of the horizontal hollow bars. In the region of the corner areas, bent 90° and parallel, respectively perpendicular relative to the vertical direction, the horizontal hollow bars 30 of the cage jacket 14 are flattened, such that they also act as a hinge-type "bending joint". The horizontal hollow bars need not possess a high bending resistance in the corner area, respectively perpendicular relative to the vertical direction; of greater importance here is a higher elasticity. Particularly favorable test results were realized with pallet containers that have horizontal hollow bars 30 which are flattened in the corner areas 38 of support jacket 14 from the inside and/or from the outside by at least one fourth of the height H of the diameter of the profile 18. In one of the embodiments actually built, the horizontal hollows in the lower region of the cage jacket are flattened from the inside by about 20% and form the outer corner arch by about 35%, while of flattening in the upper region of the cage jacket are configured so they are incrementally reduced.

Figure 17:
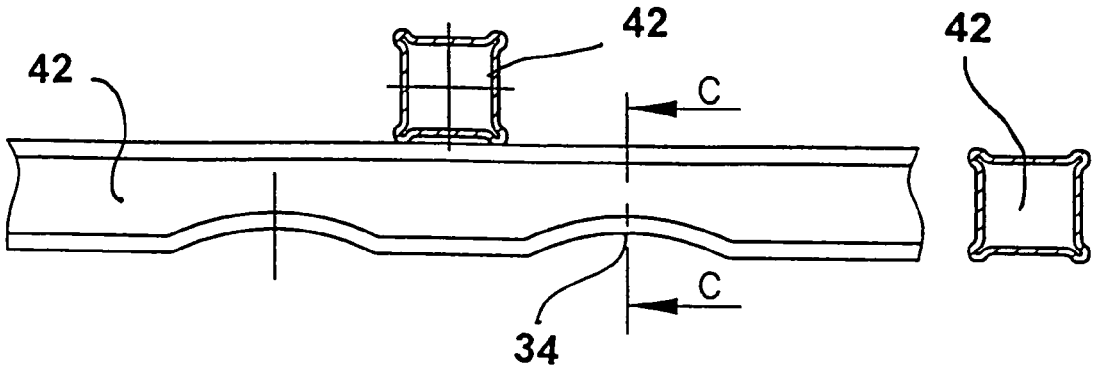
FIG. 17 a square shaped hollow bar profile with two dimples.
Figure 17:
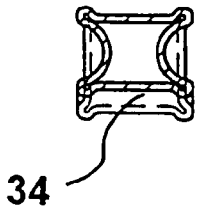
Figure 18:
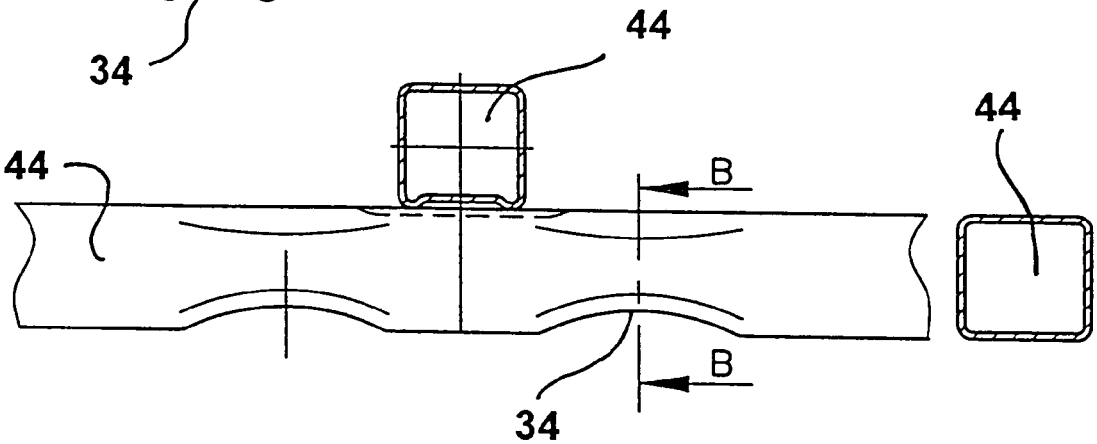
FIG. 18 a further square shaped hollow bar profile with two-four dimples.
Figure 18:
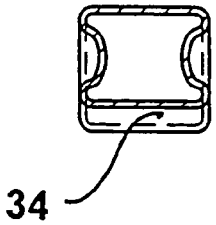

In FIG. 17 an intersection of two hollow bars with a special square shaped profile 42 is depicted. There, the hollow walls are slightly indented along the entire length if the bar, so that at the intersection of the hollow bars a four-point contact is realized, by which the hollow bars are welded to each other. In section along area C—C an dimple is shown. FIG. 18 shows a similar hollow bar profile 44 with a square shaped cross section of the vertical and horizontal hollow bars, wherein here, a partial dimple of one of the hollow walls was only formed in the area of the intersection such, that a four-point contact by which the two crossing hollow bars are welded to each other was likewise realized. Section along area B—B also shows an dimple 34.

Figure 19:
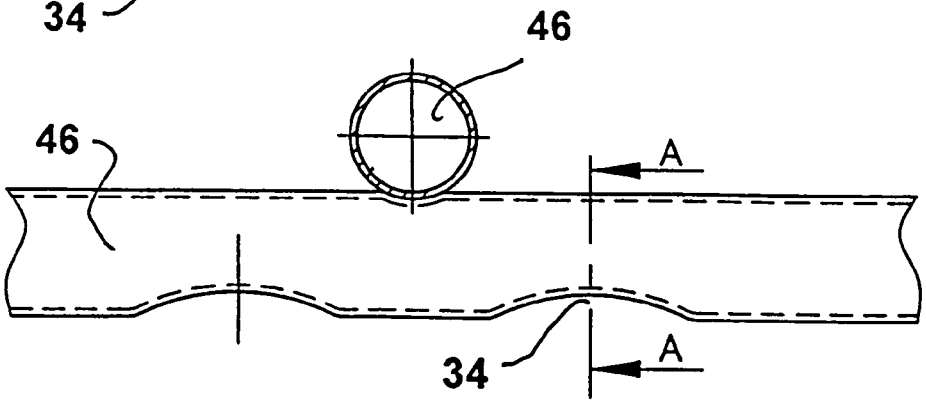
FIG. 19 a circular cross section of a hollow bar with two dimples.
Figure 19:
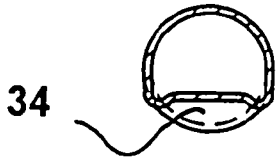
Figure 20:
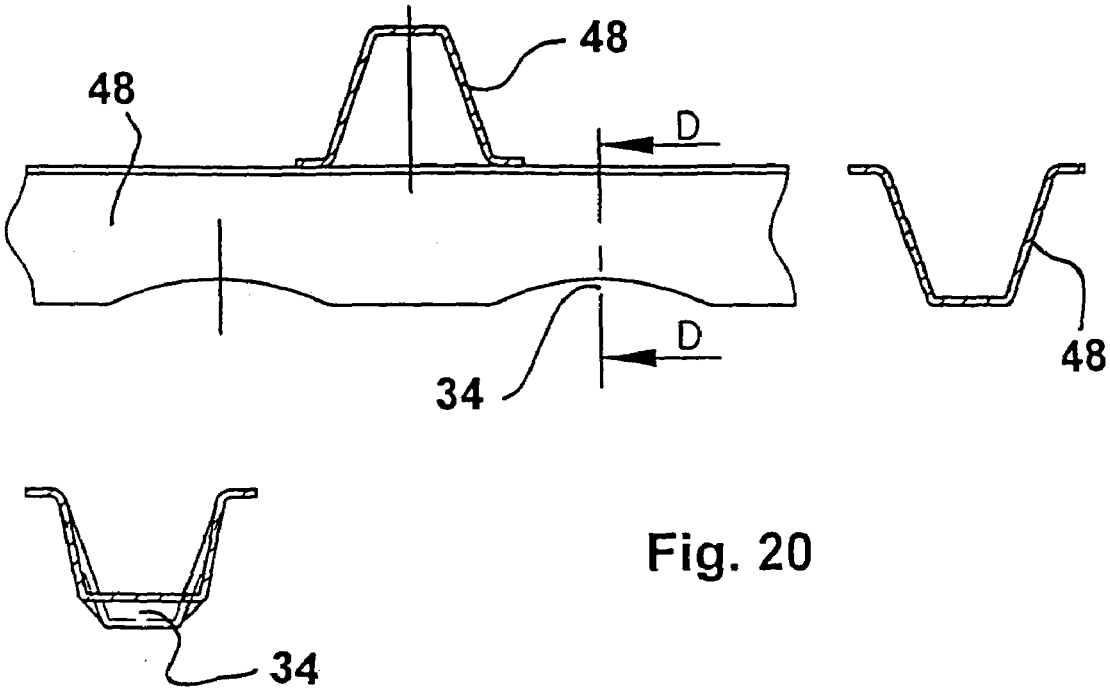
FIG. 20 an open trapezoid shaped hollow bar profile with two dimples.

The vertical or/and horizontal hollow bars can have a closed profile with a round, respectively circular cross-section. Such a circular profile 46 with an dimple 34 along section line A—A is shown in FIG. 19. In another embodiment, the vertical and horizontal hollow bars can have an open profile with a trapezoid shaped cross section. FIG. 20 illustrates such an open trapezoid shaped profile 48 with an dimple 34 along section line D—D.

Figure 21:
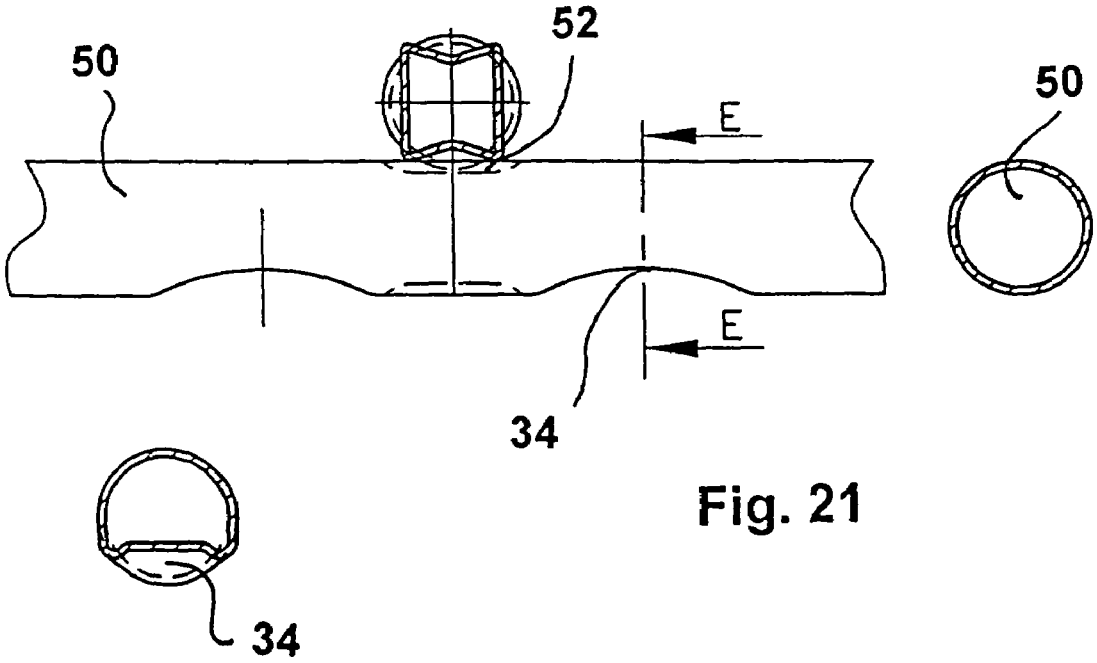
FIG. 21 a further circular cross section of a hollow bar with two dimples.

Finally, in FIG. 21, a further circular hollow profile 50 is shown, wherein the crossing hollow bars are only partially indented in the area of the intersection 52, so that a preferred four point contact is realized by which the two hollow bars are welded to each other. Here, the wanted bending points, respectively the dimples 34 are provided at the side opposite the welding point.

It is understood that the variations as shown can be combined in various ways and that other combinations are also within the ambit of the invention.

The above-presented possible variations, particularly the lower region of the cage jacket can be provided with different means for realizing sufficient flexural strength with optimal suitable hollow bar elasticity.

While the invention has been illustrated and described as embodied in a pallet container, it is not intended to be limited to the details shown since various modifications and structural changes may be made without departing in any way from the spirit of the present invention.

What is claimed is:

1. A pallet container, comprising:

a bottom pallet;

a thin-walled rigid thermoplastic receptacle for storage and transport of liquid or flowable contents;

and a cage jacket closely surrounding the plastic receptacle and securely connected with the bottom pallet; wherein the cage jacket includes horizontal and vertical hollow bars welded together in a contact area at points of intersection, wherein the hollow bars are provided laterally next to each point of intersection with at least one dimple which is spaced from the point of intersection at a distance of about one tenth of a width of the hollow bar, and wherein the at least one dimple is located on a side of the bar opposite a plane of the contact area.

2. The pallet container of claim 1, wherein the hollow bars are characterized in the contact area by an absence of dimples.

3. The pallet container of claim 1, wherein the dimple has a depth of about 2 mm.

4. The pallet container of claim 1, wherein at least one of the vertical hollow bars and horizontal hollow bars is provided between two points of intersections on one of the contact area with at least one said dimple and on the opposite side of the contact area with at least one said dimple, wherein the dimple on one side and the dimple on the other side are disposed in precise confronting relationship at a distance to the points of intersection of about one tenth of the width of the hollow bar.

5. The pallet container of claim 1, wherein the hollow bars have a cross section defined by a height, and a depth of each of the dimples being between about 15% and 50% of the height.

6. The pallet container of claim 5, wherein the depth of each of the dimples is about 33% of the height.

7. The pallet container of claim 1, wherein the hollow bars have a cross section defined by a width, wherein each of the dimples has a length which, as viewed in a longitudinal direction of the bars, is approximately between one and one half to three times the width of the cross section.

8. The pallet container of claim 7, wherein the length is about twice the width of the hollow bar.

9. The pallet container of claims 1 wherein the dimples in the hollow bars are configured with varying depths in dependence on an intensity of dynamic vibrational stress encountered in locations selected from the group consisting of various sections of the cage jacket, and in the horizontal and vertical hollow bars.

10. The pallet container of claim 1 wherein at least one of the vertical or horizontal hollow bars has a closed profile of a trapezoid cross section, thereby defining a longer wall and a shorter wall in parallel relationship, and two straight walls extending obliquely relative to each other toward one another from the longer wall toward the shorter wall at an angle between 20° and 45°.

11. The pallet container of claim 10, wherein the angle is about 36°.

12. The pallet container of claim 10, wherein the trapezoid profile is defined by a height and a width, wherein the ratio between height and width is in the range between 0.8 and 1.0.

13. The pallet container of claim 12, wherein the ratio is about 0.86.

14. The pallet container of claim 10, wherein the longer wall of the trapezoid-shaped profile of the hollow bar is inwardly indented along an entire length of the hollow bar to define two outer longitudinal edges which are each formed with an outwardly projecting bulge so as to provide at each point of intersection of vertical and horizontal hollow bars four contact points which are firmly connected to each other after welding, whereby at each point of intersection of hollow bars confronting ones of said longer wall are still spaced from each other and without being in contact.

15. The pallet container of claim 10, wherein the longer wall of a one of the hollow bars is spaced form a longer wall of another one of the hollow bars at a point of intersection by a distance of about 0.5 mm to 2 mm after the welding.

16. The pallet container of claim 15, wherein the distance is about 1 mm.

17. The pallet container claim of claim 13, wherein a remaining portion of the longer wall between the bulged outer longitudinal edges has a same width as a width of the opposite shorter wall, as viewed in cross section of the trapezoid-shaped profile.

18. The pallet container claim of claim 14, wherein a remaining portion of the longer wall between the bulged outer longitudinal edges has a same width as a width of the opposite shorter wall, as viewed in cross section of the trapezoid-shaped profile.

19. The pallet container of claim 1, wherein the hollow bars have an open profile with a cross section which has a trapezoid or substantially trapezoid configuration.

20. The pallet container of claim 1, wherein the hollow bars have a closed profile with a cross section selected from the group consisting of rectangular cross section, square cross section, round cross section and circular cross section.

21. The pallet container of claim 1, wherein the hollow bar is slightly inwardly indented by about no more than 2 mm along an entire length of the hollow bar to define two outer longitudinal edges which are each formed with an outwardly projecting bulge so as to provide at each point of intersection of vertical and horizontal hollow bars four contact points which are firmly connected to each other after welding, whereby at each point of intersection of hollow bars confronting ones of said longer wall are still spaced from each other and without being in contact.

* * * * *